US005240330A

United States Patent [19]

Thompson

[11] Patent Number: 5,240,330

[45] Date of Patent: Aug. 31, 1993

[54] COMBINATION CUSHION AND ORGANIZER

[76] Inventor: Richard P. Thompson, 348 Jefferson Ave., Canandaigua, N.Y. 14424

[21] Appl. No.: 966,424

[22] Filed: Oct. 26, 1992

[51] Int. Cl.[5] ..... B65D 33/14

[52] U.S. Cl. ..... 383/4; 383/16; 383/22; 383/38; 383/87; 383/97; 297/183; 297/397; 224/151; 5/639

[58] Field of Search ..... 383/4, 16, 21, 22, 38, 383/39, 87, 97, 107, 118; 224/151, 155, 202; 297/183, 219, 397; 5/639, 462, 419

[56] References Cited

U.S. PATENT DOCUMENTS

| | | | |
|---|---|---|---|
| 1,677,743 | 7/1928 | Berton | 383/4 X |
| 2,404,109 | 7/1946 | Steele | 5/639 X |
| 3,632,029 | 1/1972 | Sonner | 383/22 X |
| 4,096,929 | 6/1978 | Frey et al. | 383/38 X |
| 4,240,480 | 12/1980 | Strobel | 383/16 X |
| 4,535,878 | 8/1985 | Grahl | 383/4 X |
| 4,863,003 | 9/1989 | Carter | 383/4 X |

*Primary Examiner*—Allan N. Shoap
*Assistant Examiner*—Jes F. Pascua
*Attorney, Agent, or Firm*—Robert J. Bird

[57] ABSTRACT

A beach chair bundle includes first, second, third, and fourth panels of terry cloth. The second and third panels are joined by an elastic strip. The second panel is folded up on the first and fastened to it along side edges to form a pouch for a removable pillow. The third panel extends over the pillow pouch and down over the first panel to form an inverted envelope adapted to slip over a chair back. The fourth panel is folded up on the third and fastened to it along side edges to form a utility pocket. A flap cover and fastening strips hold the pocket closed. Tie loops connect the pillow pouch to the utility pocket, through the chair structure, to secure the beach chair bundle to the chair. A fastening strip across the lower exterior of the first panel, and a zipper half across the bottom exterior of the utility pocket provide for attachment of a towel and a bag respectively.

5 Claims, 1 Drawing Sheet

COMBINATION CUSHION AND ORGANIZER

FIELD OF THE INVENTION

This invention is a combination cushion and organizer for use as a pillow and as a handy receptacle for sundry articles, particularly for use with beach or lawn furniture. I call the device a "beach chair bundle".

BACKGROUND INFORMATION

Outdoor recreation often requires transporting a variety of articles, big and small, e.g. beach chair, cooler, radio, camera, sunglasses, lotion, reading material, and so on. Carrying these several articles to the desired destination and keeping them organized, especially the smaller items, can be a nuisance.

Tote bags are one way to carry such articles. More elaborate devices have been described in the prior art. U.S. Pat. No. 4,863,003 to Carter discloses a combination seat cushion and tote bag. It includes a central seating portion and foldable end portions. A cushion fits within the central portion, and the end portions are convenience pockets which hang down from the central seating portion when it is in place on a chair.

SUMMARY OF THE INVENTION

The beach chair bundle of this invention includes first, second, third and fourth panels of terry cloth. The second and third panels are joined by an elastic strip. The second panel is folded up on the first and fastened to it along side edges to form a pouch for a removable pillow. The third panel extends over the pillow pouch and down over the first panel to form an inverted envelope adapted to slip over a chair back. The fourth panel is folded up on the third and fastened to it along side edges to form a utility pocket. A flap cover and fastening strips hold the pocket closed. Tie loops connect the pillow pouch to the utility pocket, through the chair structure, to secure the beach chair bundle to the chair. A fastening strip across the lower exterior of the first panel, and a zipper half across the bottom of the utility pocket provide for attachment of a towel and a bag respectively.

DRAWING

DESCRIPTION

Figure 1:
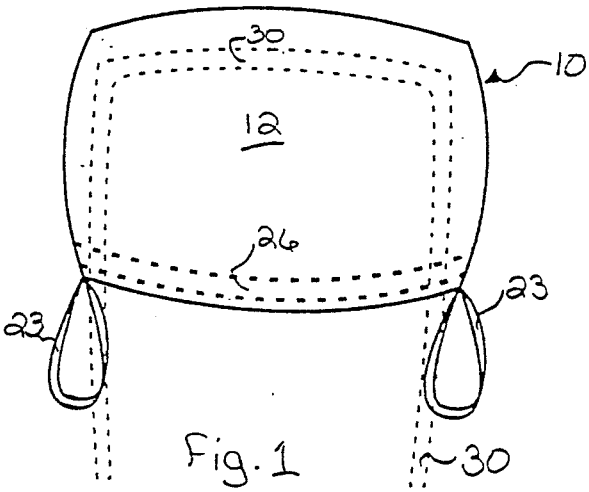
FIG. 1 is a front view of my beach chair bundle.
Figure 4:
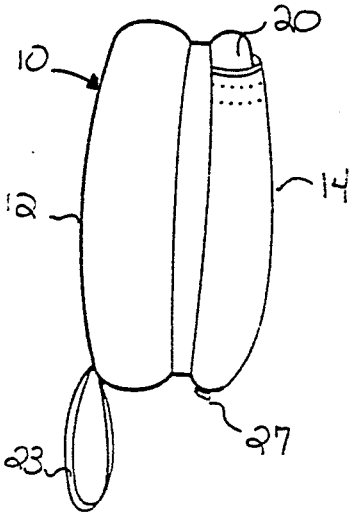
FIG. 4 is a right side view of FIG. 1.
Figure 3:
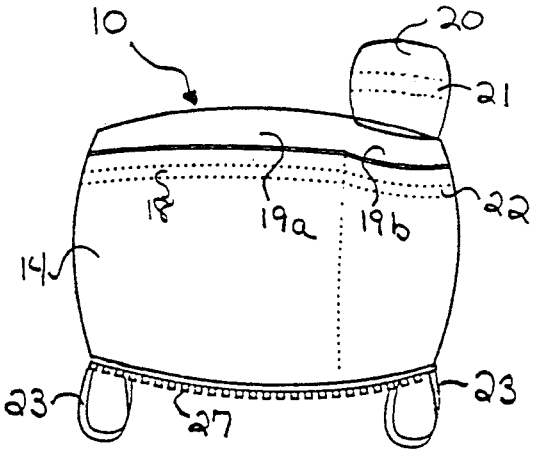
FIG. 3 is a rear view of FIG. 1.

FIG. 1 is a front view of my beach chair bundle 10 mounted on the back of a beach chair 30. FIGS. 3 and 4 are rear and side views of the bundle by itself.

Figure 5:
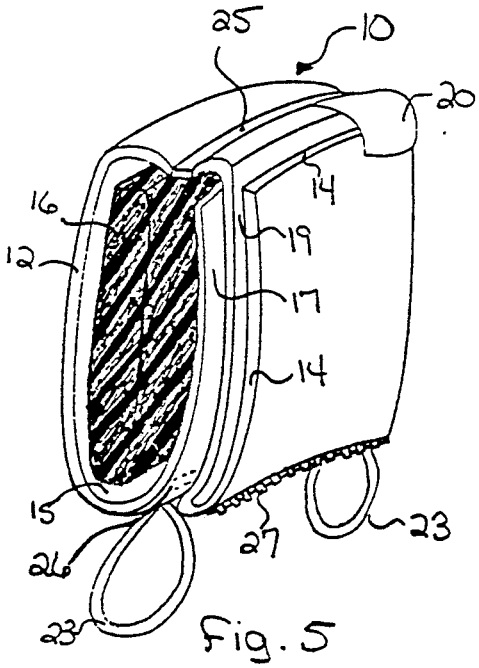
FIG. 5 is a vertical section on the plane 5—5 of FIG. 3.

The structure of the beach chair bundle 10 is best shown in the sectional view of FIG. 5. The beach chair bundle 10 is formed of a first panel 11 and second panel 12 of one continuous piece of fabric, and a third panel 13 and fourth panel 14 of another continuous piece of fabric. The fabric is preferably terry cloth. The second panel 12 and third panel 13 are joined by an elastic strip or "waist band" 25.

The second panel 12 is folded back up on the first panel 11, and their vertical side edges are sewn together. Panels 11 and 12 together form a pillow pouch 15. A pillow 16 is removably inserted into the pouch 15.

The third panel 13 is folded over the top of the pillow pouch 15 and down over the first panel 11. Panels 11 and 13 together form an inverted envelope 17 to fit over a supporting structure such as the back of a beach chair 30.

The fourth panel 14 is folded back up on the third panel 13, and their vertical side edges are sewn together. Panels 13 and 14 together form a utility pocket 19. The top edge of the fourth panel 14, and the adjoining edge of the third panel 13, include mating strips 18 of VELCRO fastening material to close and fasten the utility pocket 19.

The utility pocket 19 may be a single large pocket from side to side of the beach chair bundle, but I prefer to divide the pocket 19 into smaller pockets such as **19*a* and 19*b*, by appropriate stitching as shown in FIG. 3**.

FIG. 3 also shows a cover flap 20 over the smaller pocket **19*b*. The flap 20 includes a strip 21 of VELCRO lastening material for connection with a mating strip 22 on the exterior of the pocket 19*b***.

In FIG. 5, a transverse strip 26 of VELCRO fastening material extends across the lower exterior of the first panel 11 for attachment to a mating VELCRO strip across the end of a beach towel (not shown) to anchor the beach towel in place on the beach chair.

A zipper strip 27, i.e. one half of a mating pair of zipper strips, extends across the bottom exterior of the utility pocket 19 for attachment to a mating zipper strip on a bag such as a cooler bag (not shown).

Figure 2:
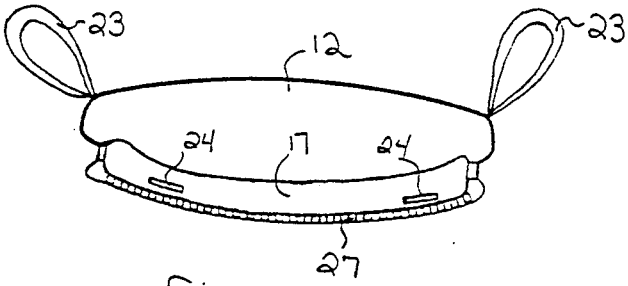
FIG. 2 is a bottom view of FIG. 1.

The beach chair bundle 10, by means of its inverted envelope 17 slips over the back of a beach chair 30. Tie loops 23 extend from the bottom of the pillow pouch 15. Buttons 24 are mounted on the bottom inside of the third panel 13 (see FIG. 2). The tie loops 23 pass through the back of the chair 30 for attachment to the buttons 24, securing the beach chair bundle in place on the chair.

The elastic "waist band" 25 connecting the second panel 12 to the third panel 13 gives some stretch to the device so that it fits snugly over the backs of most beach and lawn chairs.

The foregoing description of a preferred embodiment of this invention, including any dimensions, angles, or proportions, is intended as illustrative. The concept and scope of the invention are limited only by the following claims and equivalents thereof.

What is claimed is:

1. A beach chair bundle, including:

first and second panels of one piece of fabric, third and fourth panels of another piece of said fabric, and an elastic strip joining said second and third panels;

said second panel folded up on said first panel and fastened thereto along the side edges thereof, forming therewith a pillow pouch; having a top adjacent said elastic strip said third panel extending over the top of said pillow pouch and down over said first panel, forming therewith an inverted envelope adapted to slip over a supporting structure;

said fourth panel folded up on said third panel and fastened thereto along the side edges thereof, forming therewith a utility pocket;

closure means to close the top of said pocket; and releasable tie loops to tie the bottom of said pillow pouch to the bottom of said utility pocket to secure said beach chair bundle on said supporting structure.

2. A beach chair bundle as defined in claim 1, further including:

a strip of fastening material across the lower exterior of said first panel, and a zipper half across the bottom exterior of said utility pocket.

3. A beach chair bundle as defined in claim 1, further including a pillow disposed in said pillow pouch.

4. A beach chair bundle as defined in claim 1, in which said fourth panel is further fastened to said third panel along a vertical line between said edges, forming a plurality of utility pockets.

5. A beach chair bundle as defined in claim 2, said sheet being of terry cloth.

* * * * *